United States Patent [19]

de La Tour

[11] Patent Number: 4,731,896

[45] Date of Patent: Mar. 22, 1988

[54] ADJUSTABLE TOOTHBRUSH

[76] Inventor: Odette de La Tour, 16 W. 82nd St., New York, N.Y. 10024

[21] Appl. No.: 789,495

[22] Filed: Oct. 21, 1985

[51] Int. Cl.[4] ..... A46B 7/00; A46B 9/04; A61C 15/00

[52] U.S. Cl. ..... 15/106; 15/110; 128/62 A; 403/93; 403/97; 403/157

[58] Field of Search ..... 15/106, 110, 144 R, 15/167 R, 167 A, 172; 128/62 A; 403/93, 97, 157, 159

[56] References Cited

U.S. PATENT DOCUMENTS

| | | | |
|---|---|---|---|
| 663,121 | 12/1900 | Frost | 403/97 X |
| 1,092,014 | 3/1914 | Briggs | 15/172 |
| 1,369,664 | 2/1921 | Izawa | 15/167 R |
| 1,658,383 | 2/1928 | Lewis | 403/93 |
| 1,796,893 | 3/1931 | McVeigh | 128/62 A |
| 1,993,662 | 3/1935 | Green | 128/61 A X |
| 2,022,561 | 11/1935 | Gray | 403/97 X |
| 2,047,613 | 7/1936 | Brown | 403/97 |
| 2,800,899 | 7/1957 | Barron | 15/167 R X |
| 3,922,481 | 11/1975 | Lewis | 403/97 X |
| 3,939,520 | 2/1976 | Axelsson | 15/106 X |
| 4,330,896 | 5/1982 | Booth | 15/167 R X |
| 4,413,870 | 11/1983 | Labutski | 403/97 X |
| 4,517,701 | 5/1985 | Stanford | 15/106 |

FOREIGN PATENT DOCUMENTS

| | | | |
|---|---|---|---|
| 534114 | 9/1931 | Fed. Rep. of Germany | 15/172 |
| 1230365 | 3/1960 | France | 15/167 A |
| 128951 | 12/1928 | Switzerland | 15/167 R |
| 293641 | 7/1928 | United Kingdom | 15/172 |

*Primary Examiner*—Wm. Carter Reynolds
*Attorney, Agent, or Firm*—William V. Pesce

[57] ABSTRACT

A toothbrush having two arms pivotally jointed with cleansing means at the other extremities of both arms. The jointed section comprises several methods for manipulating and indexing the arms relative to each other to permit brushing in various parts of the mouth. The jointed section is composed of bifurcated bridging members for one arm, and an accommodating bar at the other arm disposed to lie between the bridging members. The bridging members and bar are pivotally held together by a control pin which can be manipulated to permit one arm to move relative to the other. The bar and bridging members may be frictionally in contact with each other or can be connected thru gearing and socket devices each disposed to function through special control pins for causing the engagement and disengagement of the said gear and socket devices. Simple finger manipulation of the controlling pin causes selective indexing of the toothbrush arms relative to each other.

10 Claims, 24 Drawing Figures

ADJUSTABLE TOOTHBRUSH

The present invention relates in general to toothbrushes, and in particular is directed to toothbrushes having an adjustable handle for selective placement of the brush portion to facilitate brushing, and cleaning both teeth and gums in various parts of the mouth.

Proper care of the teeth requires the proper brushing thereof in all parts of the mouth, including the front and back portions of the teeth and the massaging of gums. Toothbrushes presently provide adequate results when brushing the front of the mouth or teeth, but not adequate enough where remote areas of the mouth are concerned.

Toothbrushes come in a variety of forms, shapes and materials to not only clean or brush teeth, but they are designed to have some ecstetic look about them for selling purposes. However, by and large they all are made of a single handle with bristles thereon at one end of the handle. There are some brushes with articulated handles but their adjustments are not pre-selective. Some of the prior art may be found in the following patents; U.S. Pat. Nos. 1,369,664; 1,417,407; 2,216,026; 2,668,308; 2,800,899; 3,493,991; 4,330,896.

It is the intention herein to describe a novel new toothbrush which provides for the selective adjustment thereof in a new and novel manner. The handle is made in two separate parts, and hinges connected to form a single integrated handle. The connection between the parts is provided by a slot and bar arrangement having communicating bores, each with or without circular gear arrangements for appropriate indexing of the parts by special keying member between bores to lock in the connecting parts, or to dis-engage them.

It is therefore an object of the invention to provide an improved adjustable toothbrush.

Another object of the invention is to provide a toothbrush which makes it possible to have access to portions of the mouth not readily accessable.

A still further object of the invention is to provide a toothbrush that renders improved cleansing and appropriate hygiene for the teeth.

Another object of the invention is to provide a toothbrush which is simple, compact, easy to carry and store for home or travel purposes, and economical to use.

Other objects and advantages will become apparent from a reading of the specifications, and a study of the accompanying drawings.

Figures 1, 2, 3, 4, 5:
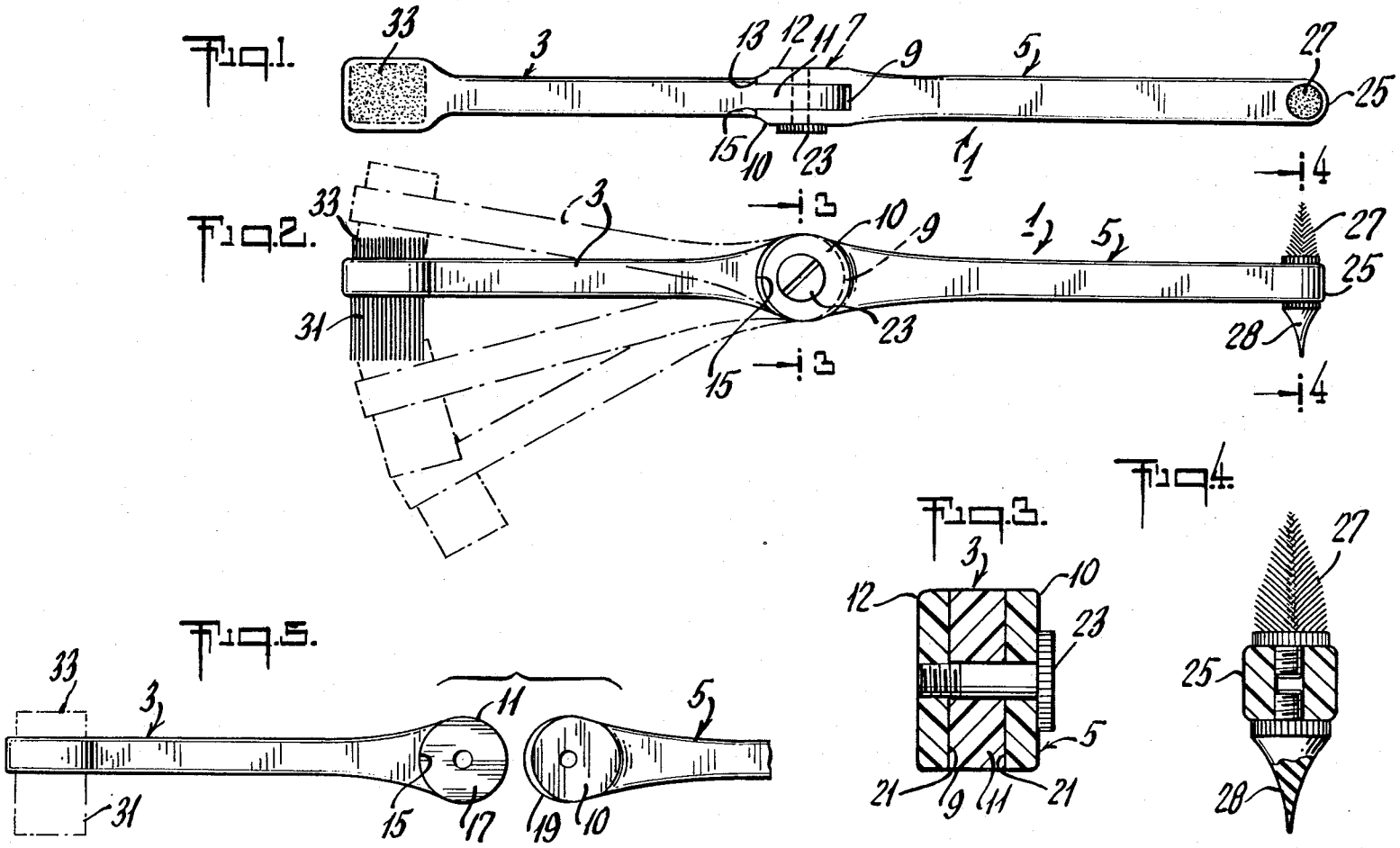
FIG. 1 is a plan view of an adjustable articulated toothbrush according to one embodiment of the invention.
FIG. 2 is an elevational view of FIG. 1 showing various adjustable positions of the toothbrush.
FIG. 3 shows a sectional view thru the line 3—3 of FIG. 2.
FIG. 4 shows a sectional view thru the line 4—4 of FIG. 2.
FIG. 5 shows partially and separate the jointed sections of the articulated toothbrush of FIG. 1.
Figure 6:
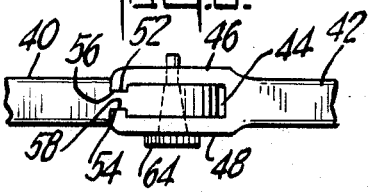
FIG. 6 shows partially a plan view of an articulated joint of a toothbrush according to another embodiment of the invention.
Figure 8:
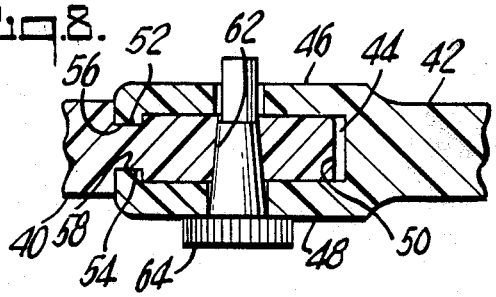
FIG. 8 shows a sectional view thru the line 8—8 of FIG. 7.
Figure 7:
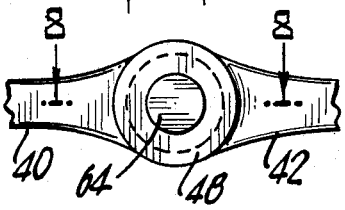
FIG. 7 shows an elevational view of FIG. 6.
Figure 9:
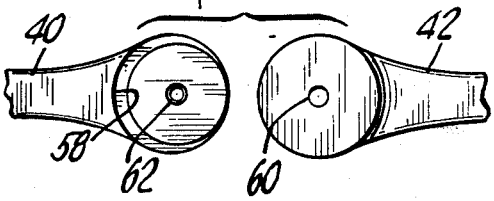
FIG. 9 shows partially the jointed sections of the toothbrush of FIG. 6.

Now describing the invention with respect to the various embodiments as depicted in the numbered drawing, there is shown in particular with respect to FIGS. 1–5 an articulated toothbrush 1 having a pair of handles or arms 3,5, articulated or jointed at one end of their arms 7, arm 5 being slotted or bifurcated 9 to receive a bar 11 with abutments 13,15. The jointed ends of FIG. 1 are shown separated in FIG. 5. Arm 3 has at its jointed end a circular—like tongue 17 disposed to enter the circular grooved area 19 of arm 5 at its corresponding jointed end. The abutment 13,15 of Arm 3 is a circular track 21 upon which the bifurcated sections 10,12 are in contact with during the rotational adjustments of the arms relative to each other.

The bifurcated joint or slot 19 is narrower than the tongue 17 because of the extrusion process in the creation of the arms 7. A bending moment is created at the base of the slot when the tongue is placed within the slot so that the tongue is held in place within the tracking area 21.

The arms 3,5 are held together and made pivotally operable by a screw or pins 23 as shown in FIG. 3. The bifurcated arm 5 along the slotted portion 9 and tongue 17 each have corresponding bores for receiving the adjustable screw 23 which threads into a slotted part so that the slots and tongue will be held relatively ridgid with respect to each other. The adjustment of the screw makes it possible to rotatably move one arm relative to the other during the brushing process.

Arm 5 contains at another extremity 25 a special pair of teeth care items. One such item is a coned shape brush 27 secured to said extremity, and a corresponding coned shaped malleable tip 28, both the brush and tip being disposed to penetrate spaces between the teeth for the better care thereof. As shown in FIG. 2, the arm 3 rotates about a pivotal axis at which the pin 23 is located, to adjust the said arm so that the brush 31 having extensive bristles will appropriately engage the teeth in any suitable area. The brush 31 is located at an extremity of arm 3, and has on it's opposing surface a short depending brush 33 for adequately massaging the gums in all areas of the mouth. Both brush 27 and tip 28 are provided with a threaded shaft for engaging the extremity 25 of arm 5 and to become secured thereto.

FIGS. 6–9 show another embodiment of the invention and wherein the toothbrush arms 40,42 represent the comparable arms 3,5 of FIG. 1. Here again arm 42 is bifurcated into a slot 44 with bridging arm sections 46,48 bridging a bar 50 of arm 40. The sections 46,48 have their extremities folded or beaded over 52,54 to embrace grooves 56,58 along both surfaces of bar 50. Both the bifurcated arms 46,48 and bar 50 have corresponding bores 60,62 for receiving a tapered pin 64 for controlling the movements of arms 40,42 about their articulating joint. The taper of pin 64 has the effect of controlling the forces rotating the arms 40,42 with respect to each other. Hence moving the tapered screw in an up and down fashion controls the forces of the rotation of the arms of the toothbrush. Also the arms cannot disengage because of the beaded over segments 52,54 of arm 42 which embraces the grooves 56,58 on the arm 40.

Figure 10:
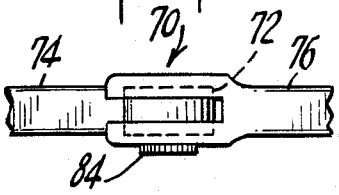
FIG. 10 shows partially a plan view of an articulated joint of a toothbrush according to still another embodiment of the invention.
Figure 12:
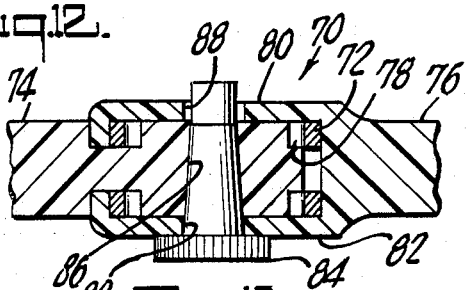
FIG. 12 shows a section thru the lines 12—12 of FIG. 11.
Figure 11:
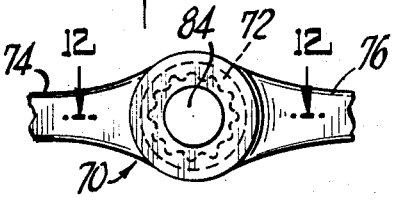
FIG. 11 shows an elevational view of FIG. 10.
Figure 13:
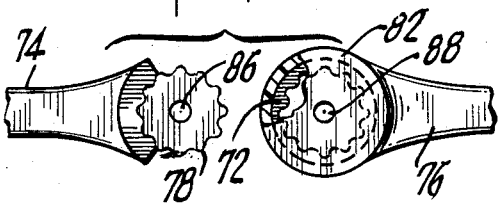
FIG. 13 shows partially the jointed section of the toothbrush of FIG. 10.

FIGS. 10–13 show still another embodiment of the invention as characterized by the jointed sections. In particular the jointed sections 70 have a special gearing-like arrangement 72 for the arms to engage themselves at their articulated joints. Again referring to the respective figures, FIG. 13 shows the separated parts 74,76 of a toothbrush handle, with part 74 having a rotating gear 78 pivotally secured to one end of part 74, and a gearing socket 80 having comparable gearing recesses for receiving gear 78 when engageable therewith at the extension of part 76. The gear 78 and socket 80 are shown in FIGS. 10–12 in operable engagement. In particular they are held together in locked-engagement by pin 84 which is made to penetrate a pair of holes in arms 74,76 respectively. The gear 78 forms an integral part of arm 74 and rotates therewith. Socket 80 forms an integral part of arm 76 and permits arm 74 to rotate relative to arm 76. When arms 74 and 76 are in locked-engagement, they are held secure because of the holding tension of the bifurcated arms 80,82 of part 76. The gear 78 and socket 80 are caused to disengage when the screw 84 causes the tensioned arms 80,82 to separate a distance sufficient to permit movement of the gear relative to the socket. This indexing movement is simply performed by moving one arm relative to the other when the screw 84 is operated. The operation ceases when the screw is tightened. It is possible to move the arms in any rotational direction any number of set peripheral positions.

Figure 14:
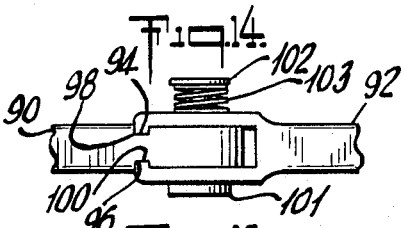
FIG. 14 shows partially a plan view of an articulated joint of a toothbrush according to another embodiment of the invention.
Figure 15:
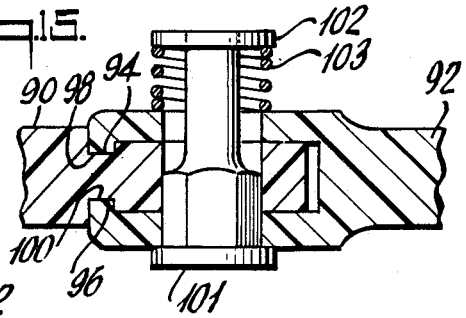
FIG. 15 shows a section thru the joint of FIG. 14.
Figure 16:
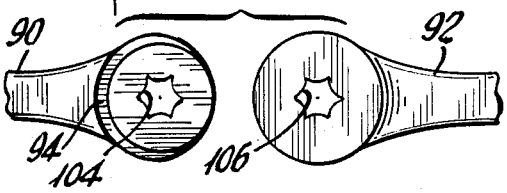
FIG. 16 shows partially the joint of FIG. 16 spaced apart.
Figure 17:
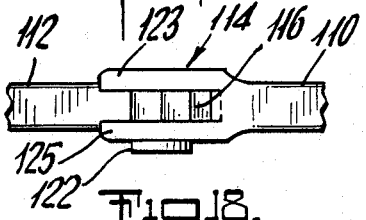
FIG. 17 shows partially a plan view of an articulated joint of a toothbrush according to another embodiment of the invention.
Figure 19:
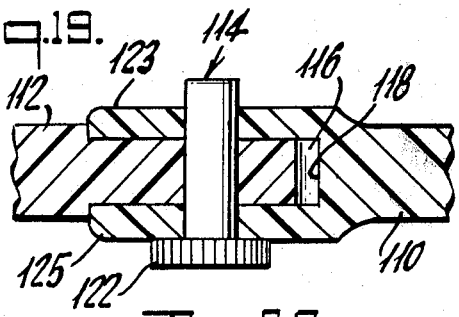
FIG. 19 shows a section thru the line 19—19 of FIG. 18.
Figure 18:
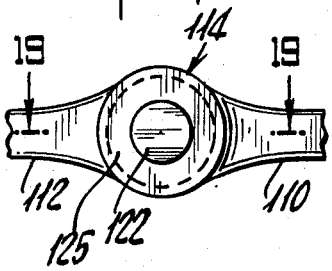
FIG. 18 shows an elevational view of FIG. 17.
Figure 20:
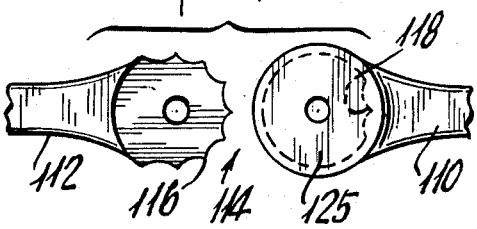
FIG. 20 shows the articulated joint of FIG. 17 with the toothbrush arms separated.
Figure 21:
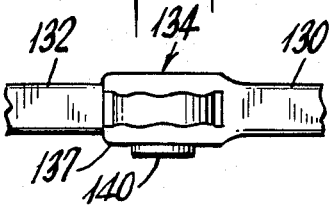
FIG. 21 shows partially a plan view of an articulated joint of a toothbrush according to another embodiment of the invention.
Figure 23:
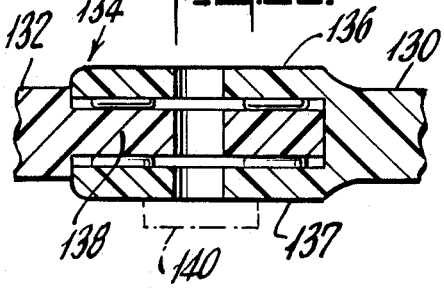
FIG. 23 shows a sectional view thru the line 23—23 of FIG. 22.
Figure 22:
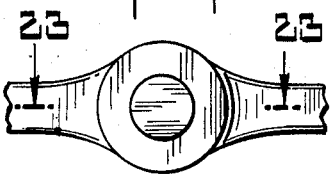
FIG. 22 shows an elevation view of FIG. 21.
Figure 24:
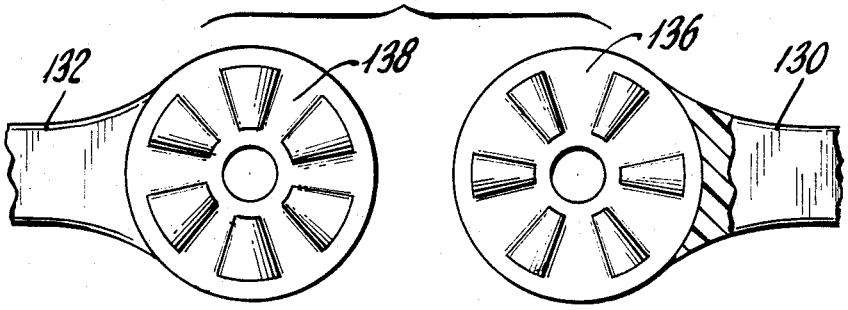
FIG. 24 shows the articulated joint of FIG. 21 with the toothbrush arms separated.

Now referring to FIGS. 14–16 there is shown still another embodiment of the invention in which a pair of arms 90,92, comprising the handle of a toothbrush, each have a pair of complimentary segmented sockets 94,96 for engagement purposes. Arm 92 is bifurcated at the jointed end, each terminus of the bifurcated arms being formed into shoulders 94,96 for retaining purposes. The arm 90 has it's terminus on both surfaces grooved to form concentric channels 98,100 for receiving the shoulders 94,96 of arm 92 when both arms 90,92 are operably engaged. A keying pin 101 is disposed to having its circumference configured similarly to the sockets 94,96 so as to engage same to permit the arm to lock in. To move one arm relative to the other, pin 101 is pressed downward against the force of retaining spring 103 so that the keying pin 101 will engage from the arm sockets to permit the relative rotation of the arms with respect to each other. When an adjustment is made, the pin 101 is released, and engagement takes place again between the two arms.

FIGS. 17–20 again shows still another embodiment of the invention, and comprises in particular a pair of arms 110,112 having at their jointed ends 114 a set of indexing gears 116 and socket 118 for engagement purposes when the arms are connected. In particular arm 110 is bifurcated at one end to form a slot, the base thereof 118 being serated or scalloped to receive similarly shaped indentation or gear 116 disposed on arms 112 at the end thereof. Arm 112 slides into the slotted area caused by the bifurcation of arm 110, so that the gear 116 and socket 118 become operably engaged. The arms are held together by pin 122 about which both pivotally rotate when they are made operable. The release of pin 122 causes the bifurcated arms 123,125 to spread permitting the engaged gear 116 and socket 118 to become dis-engaged thereby permitting one arm 112 to rotate relative to the other arm 110.

The foregoing embodiments find their novelty in the jointed areas wherein the arms are controllably rotated thru the medium of frictional surfaces in the vertical direction. That is to say that the indexing features are produced by some form of gearing mechanism or surface friction, the arm rotation taking place along an axis orthoganal to the axis of the arms. FIGS. 21–24 show a pair of arms 130,132 jointed at their extremities 134. Arm 130 is bifurcated at the jointed extremity 134 to form a pair of bridging sections 136, 137 for embracing the bar-shaped extremity 138 of arm 132. The contact surfaces of sections 136,137 with surfaces of bar section 138 are each disposed to having, thereon a circular array of sinusoidal valleys and peaks so arranged on a surface perpendicular to an axis of the articulated arms so that the valleys on one surface engages the peaks of the other surface to maintain a locked position when so engaged. The arms 130,132 are held together by a pin 140 so that both arms can pivotally rotate with respect to each other. The release of pin 140 removes the compressive forces between the jointed arms and permits the relative rotation thereof, the valleys of one arm being rotated with respect to the peaks of the other arm until valleys and peaks of the respective bearing surfaces are matched. This form of indexing can be simply acheived by the release of the pin 140 and the urging of one arm relative to the other. When the compressive forces provided by the pin are so released, the arms can simply be rotated relative to each other by the urging thereof by finger manipulation.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

Having defined the invention what is claimed is:

1. An articulated toothbrush comprising (a) a pair of elongated articulated members connected to each other at one of their extremities which includes circular tongue and groove tracking area means for permitting the members to rotate relative to each other along said track areas, the said groove means further including bifurcated sections stressed during the engagement thereof by the tongue of one of the articulated members, (b) adjustable control means connected to said members at the said extremities for maintaining the said tongue and groove in a fixed relationship to permit the selective indexing of said members by the user in a plurality of rotational positions relative to each other, and (c) dual cleansing means at each of the other extremities of the said members for performing hygienic cleansing of the teeth and gums in different locations of the mouth.

2. A toothbrush according to claim 1 and wherein said tongue and groove tracking area means includes a circularly shaped tongue and correspondingly matched circularly shaped groove for receiving and maintaining said tongue in the tracking area during the controlled relative motion of the articulated members.

3. A toothbrush according to claim 2 and wherein said control means further includes a self-adjusting screw for maintaining area tension between the members during the rotation thereof.

4. A toothbrush according to claim 1 and wherein said tongue and groove tracking area means further includes a tongue with peripheral indent for receiving beaded extensions on said bifurcated sections in secured engagement during the controlled relative motion of said articulated members.

5. A toothbrush according to claim 4 and wherein said control means for maintaining tongue and bifurcated sections in fixed relation further includes tapered pin means disposed to create variable pressures between said tongue and bifurcated sections to allow or permit the movement or engagement of the members relative to each other.

6. A toothbrush according to claim 1 and wherein said tongue and groove tracking area means further includes circular matching gear and socket means each disposed to engage and disengage under the operation of said control means.

7. A toothbrush according to claim 6 and wherein said matching gear and socket means further includes partially scalloped gear and matching socket for simple controlled engagement and disengagement.

8. A toothbrush according to claim 6 and wherein said control means further includes moveable tensioned shaft means interlinking said tongue and bifurcated sections to allow or permit the engagement and disengagement of said tongue and bifurcated sections in accordance with the selective movement of said shaft.

9. A toothbrush according to claim 8 and wherein said tensioned shaft further includes a coil spring axially surounding said shaft to cause the shaft to move longitudinally for allowing the engagement and disengagement of the tongue and sections.

10. A toothbrush according to claims 1 and wherein said tracking area means further includes sinusoidally shaped compatable contact surfaces having peak and valleys and being disposed to engage and disengage in accordance wtih selective indexing of the articulated members along said peaks and valleys.

* * * * *